US010105590B2

(12) United States Patent
Sonnenfeld

(10) Patent No.: US 10,105,590 B2
(45) Date of Patent: Oct. 23, 2018

(54) BOARD LOGIC GAME ASSEMBLY AND METHOD

(71) Applicant: Yossef Sonnenfeld, Petah-Tikva (IL)

(72) Inventor: Yossef Sonnenfeld, Petah-Tikva (IL)

( * ) Notice: Subject to any disclaimer, the term of this patent is extended or adjusted under 35 U.S.C. 154(b) by 0 days.

(21) Appl. No.: 15/378,104

(22) Filed: Dec. 14, 2016

(65) Prior Publication Data

US 2018/0161667 A1 Jun. 14, 2018

(51) Int. Cl.
*A63F 3/00* (2006.01)

(52) U.S. Cl.
CPC ..... *A63F 3/00097* (2013.01); *A63F 3/00697* (2013.01); *A63F 2003/0063* (2013.01); *A63F 2003/0075* (2013.01)

(58) Field of Classification Search
CPC ..... A63F 3/00097; A63F 3/00697; A63F 2003/0063; A63F 2003/0075; A63F 3/694; A63F 2003/00747
USPC ..... 273/239, 281, 287, 288, 290
See application file for complete search history.

(56) References Cited

U.S. PATENT DOCUMENTS 3,274,727 A * 9/1966 Zander ..... A63F 9/06 273/282.1
3,521,383 A * 7/1970 Terwilleger ..... G09B 19/02 434/208
3,860,242 A * 1/1975 Martin ..... A63F 3/00 273/243
4,200,293 A * 4/1980 Benson, III ..... A63F 3/00697 273/260
4,647,049 A * 3/1987 Oretsky ..... A63F 3/00094 177/199
4,801,147 A * 1/1989 Miller ..... A63F 3/00 273/236
6,893,020 B1 * 5/2005 Snyder ..... A63F 9/20 273/287
8,020,867 B2 * 9/2011 Cheng ..... A63F 9/10 273/156
8,403,328 B2 * 3/2013 Vandoren ..... A63F 3/00634 273/241
2007/0114719 A1 5/2007 Floden
2008/0274665 A1 * 11/2008 Cheng ..... A63H 33/08 446/118

* cited by examiner

*Primary Examiner* — Vishu Mendiratta
(74) *Attorney, Agent, or Firm* — Edward Langer Adv & Patent Attorney

(57) ABSTRACT

A board logic game having a plurality of challenges for at least one player, the game comprising: a game board having game squares and at least one object square; at least one playing piece having a shape to fit within a game square, the at least one playing piece configured to be displaced between game squares; a challenge card specifying a maze structure, an initial game square position of the at least one game piece, and the at least one object square location; the maze structure having a maze template, the maze template including at least one maze piece, the at least one maze piece configured to be positioned within the maze template, the maze structure configured to be moved on the game board; wherein one of the plurality of challenges is solved by moving the maze structure on the game board and by thereby progressively biasing the playing piece to the at least one object square.

9 Claims, 13 Drawing Sheets

BOARD LOGIC GAME ASSEMBLY AND METHOD

FIELD OF THE INVENTION AND BACKGROUND

The current invention relates to board games in general, and specifically to a multi-level board logic game assembly and method.

In the specification and claim which follow hereinbelow, the term "logic game" is intended to mean to non-digital game, generally directed to a singular player, including cards, booklets, a board, etc. in which a series of brainteasers/puzzles/problems are presented, in increasing levels of difficulty. The words "child" and "player", as used in the specification and claim which follow hereinbelow in the context of the logic game, are used interchangeably to describe a typical game player, usually between the ages of 3-18.

While today's technology offers many advantages, there are concurrent disadvantages. Many educators and parents feel that children spend too much time with electronic games. Parents and educators therefore look for alternative activities for the children to develop their cognitive and concentration skills outside of the digital world. One of the possible activities is the field called Logic Games, which developed and spread in the last 20 years. A child playing one of these games is typically occupied for hours while improving his concentration and deductive skills. Today there are a few companies working in the field and a large array of games is available. However only a very few of the games succeed in truly combining fun with skill developments of the child.

Examples of two such outstanding games represent prior art which attempt to address the problem:

"Rush Hour", whose disclosure is incorporated herein by reference, is marketed by ThinkFun, Inc., 1321 Cameron Street, Alexandria, Va. 22314, USA. Rush hour is a "sliding block" logic game. In each challenge rectangular plastic "cars" are placed on a grid. Each "car" can be translated only forward or backward, where the objective is to move one specific "car" through an opening in the board's outline.

"Katamino", whose disclosure is incorporated herein by reference, is marketed by Gigamic ltd, ZA Les garennes, 62930 WIMEREUX, France. The current game has game pieces, with various shapes, and a game board, having a changeable size. The object of the game is to arrange all the game pieces on the board.

Another example of a prior art board game is US Patent Application Publication no. 2007/0114719, whose disclosure is incorporated herein by reference, in which Floden describes a board game assembly, including a base, a dividing wall structure extending from the base, and a plurality of removable polygonal blocks, each having a grid of holders for playing pieces. The base and dividing wall structure retain the blocks in an adjacent configuration such that the blocks combine to form an overall playing surface having an overall grid of holders. The objective of the game is to be the first to create a pattern of five playing pieces in a row. Players alternate turns, and each turn is initiated by moving a playing piece into an unoccupied holder on any of the blocks. The turn is completed by rotating any one of the blocks 90 degrees in a clockwise or counterclockwise direction.

Prior art logic games however have shortcomings including, but not limited to:

- Complicated/convoluted rules, which can significantly detract from the chances of a player/child identifying/"connecting" with the game;
- While developing cognitive skills, some of the games aren't sufficiently enjoyable for the child to retain interest in playing them;
- While some of the games are initially interesting, the child can quickly get tired of playing them; and
- Non-graduated levels of difficulty: some of the games, by nature of the game itself, involve a "jump" in difficulty at some point—a point which can frustrate/stop the child.

There is therefore a need for a board logic game which helps develop a child's cognitive skills and does it in a framework of an enjoyable game having straightforward rules, while maintaining the child's interest over time, and with gradually increased levels of difficult—all directed to encourage and have the child continue to play the game.

SUMMARY OF INVENTION

According to the teachings of the current invention, there is provided a board logic game having a plurality of challenges for at least one player, the game comprising: a game board having game squares and at least one object square; at least one playing piece having a shape to fit within a game square, the at least one playing piece configured to be displaced between game squares; a challenge card specifying a maze structure, an initial game square position of the at least one game piece, and the at least one object square location; the maze structure having a maze template, the maze template including at least one maze piece, the at least one maze piece configured to be positioned within the maze template, the maze structure configured to be moved on the game board; wherein one of the plurality of challenges is solved by moving the maze structure on the game board and by thereby progressively biasing the playing piece to the at least one object square. Most preferably, the game squares are disposed in an orthogonal configuration and the game piece has a substantially truncated cylindrical configuration, and the maze structure is configured to be moved on the game board one game square at a time. Preferably, the game board has a plurality of rounded depressions disposed in an orthogonal arrangement corresponding to game squares and the game piece has a substantially spherical configuration, and the game piece configured to rest in one of the plurality of rounded depressions, the maze structure is configured to be moved on the game board one game square at a time. Typically, the maze structure is configured to be translated in one of four possible directions on the game board. Most typically, the game squares are disposed in a hexagonal configuration and the game piece has a substantially truncated cylindrical configuration, and the maze structure is configured to be moved on the game board one game square at a time. Preferably, the maze structure is configured to be translated in one of six possible directions on the game board. Most preferably, the game squares are identified by concentric paths and the game piece has a substantially truncated cylindrical configuration. Typically, the maze structure is configured to be rotated in one of two circular directions on the game board. Most typically, the at least one playing piece and the maze template are retained in position by at least one mechanism chosen from the list including: gravitation, mechanical, and magnetic.

According to the teachings of the current invention, there is further provided a method of playing a board logic game having a plurality of challenges for at least one player, the game played according to the following steps: dividing a game board into game squares and indicating at least one object square; placing at least one playing piece having a shape to fit within a game square, the at least one playing piece being displaced between game squares; specifying on a challenge card: a maze structure; an initial game square position of the at least one game piece; and the at least one object square location; and positioning at least one maze piece within a maze template, thereby yielding the maze structure and moving the maze structure on the game board; whereby solving one of the plurality of challenges is performed by moving the maze structure on the game board and by thereby progressively biasing the playing piece to the at least one object square. Preferably, the game squares are disposed in an orthogonal configuration and the game piece has a substantially truncated cylindrical configuration, and the maze structure is moved on the game board one game square at a time. Most preferably, the game board has a plurality of rounded depressions disposed in an orthogonal arrangement corresponding to game squares and the game piece has a substantially spherical configuration, and the game piece resting in one of the plurality of rounded depressions, the maze structure moved on the game board one game square at a time. Typically, the maze structure is translated in one of four possible directions on the game board. Most typically, the game squares are disposed in a hexagonal configuration and the game piece has a substantially truncated cylindrical configuration, and the maze structure moved on the game board one game square at a time. Preferably, the maze structure is translated in one of six possible directions on the game board. Most preferably, the game squares are identified by concentric paths and the game piece has a substantially truncated cylindrical configuration. Typically, the maze structure is rotated in one of two circular directions on the game board.

LIST OF FIGURES

The invention is herein described, by way of example only, with reference to the accompanying drawings, wherein.

DETAILED DESCRIPTION

Embodiments of the present invention relate to board games in general, and specifically to a multi-level board logic game assembly and method.

Figure 1:
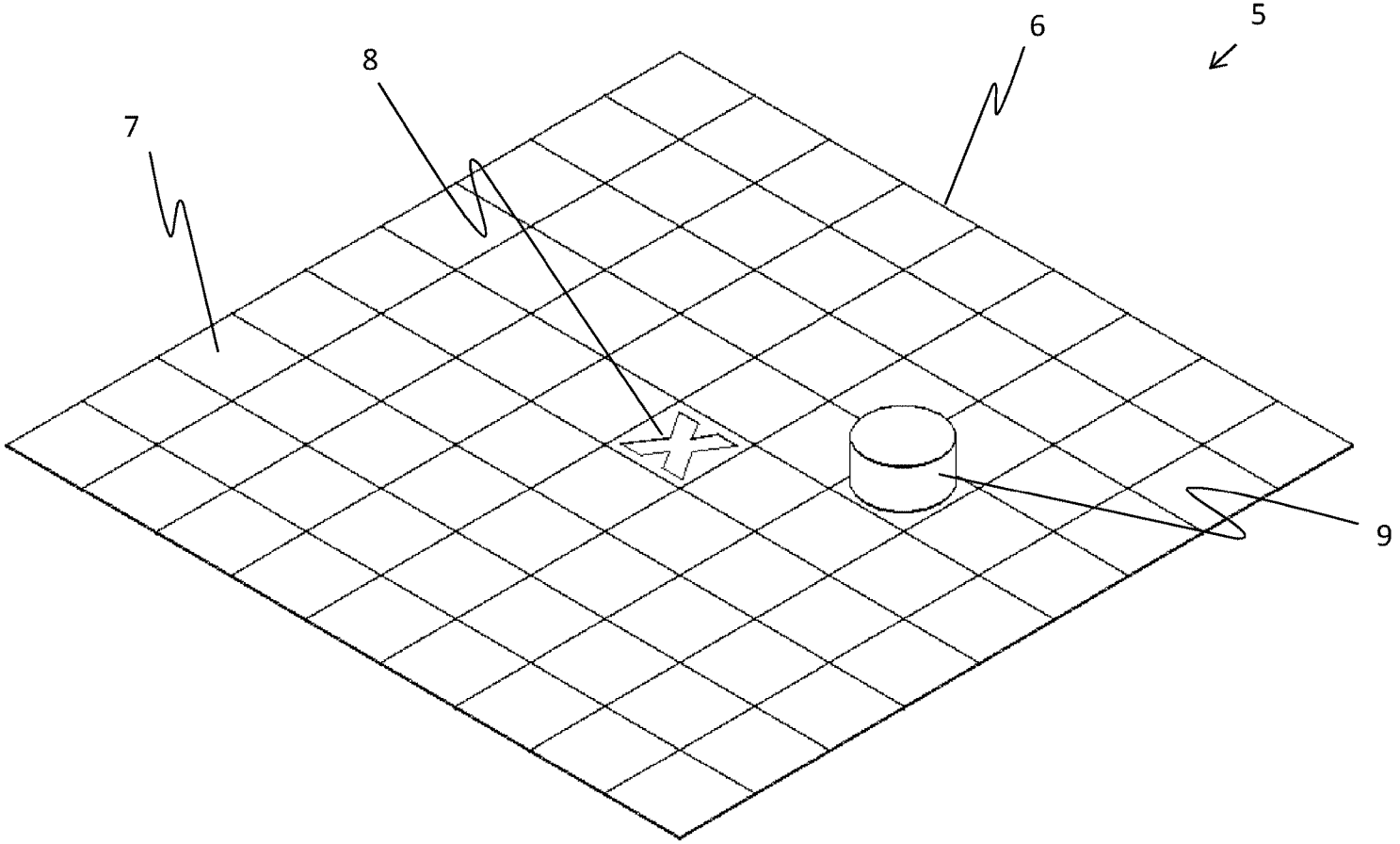
FIG. 1 is a pictorial representation of a board game having a board, in accordance with a an embodiment of the current invention.

Reference is currently made to FIG. 1, which is pictorial representation of a logic board game 5, having a board 6, in accordance with a an embodiment of the current invention. Board 6 is divided into 9×9 squares, with square 7 indicated as a typical game square, as shown in the figure. As will become apparent hereinbelow, the board need not have the exact 9×9 square configuration and/or the board may have a larger or smaller number of squares—or a larger or smaller overall board size—yielding one or more games with varying difficulty levels, for example, according to age.

In the specification and claims which follow, the word "game" (as in "object of the game" or "play the game") and the word "challenge" are intended to mean the same—meaning the activity of preparing, placing, and moving game elements on the game board—all as described below. Typically a plurality of games/challenges may be played, as described below.

In the middle of board 6 is an object square 8, having an "X" indication. A game piece 9 is shown positioned on one of the game squares. Game piece 9 is shaped to fit within a game square and has a substantially truncated cylindrical configuration, similar to game pieces used, for example, in checkers. Object square 8 represents the square to which game piece 9 is to be moved, as an object of the game—allowing the player to solve the current challenge. Although object square 8 is shown in the current and following figures in the middle of board 6, other embodiments of logic board game 5 include alternate positions of the object square, as described further hereinbelow.

In the course of the game, game piece 9 is moved from square to square and eventually to object square 8, by moving a maze (not shown in the current figure) positioned on the board; with parts of the maze serving to advance the game piece from square to square. The structure of the maze and how it is positioned/placed are described hereinbelow.

Figure 2:
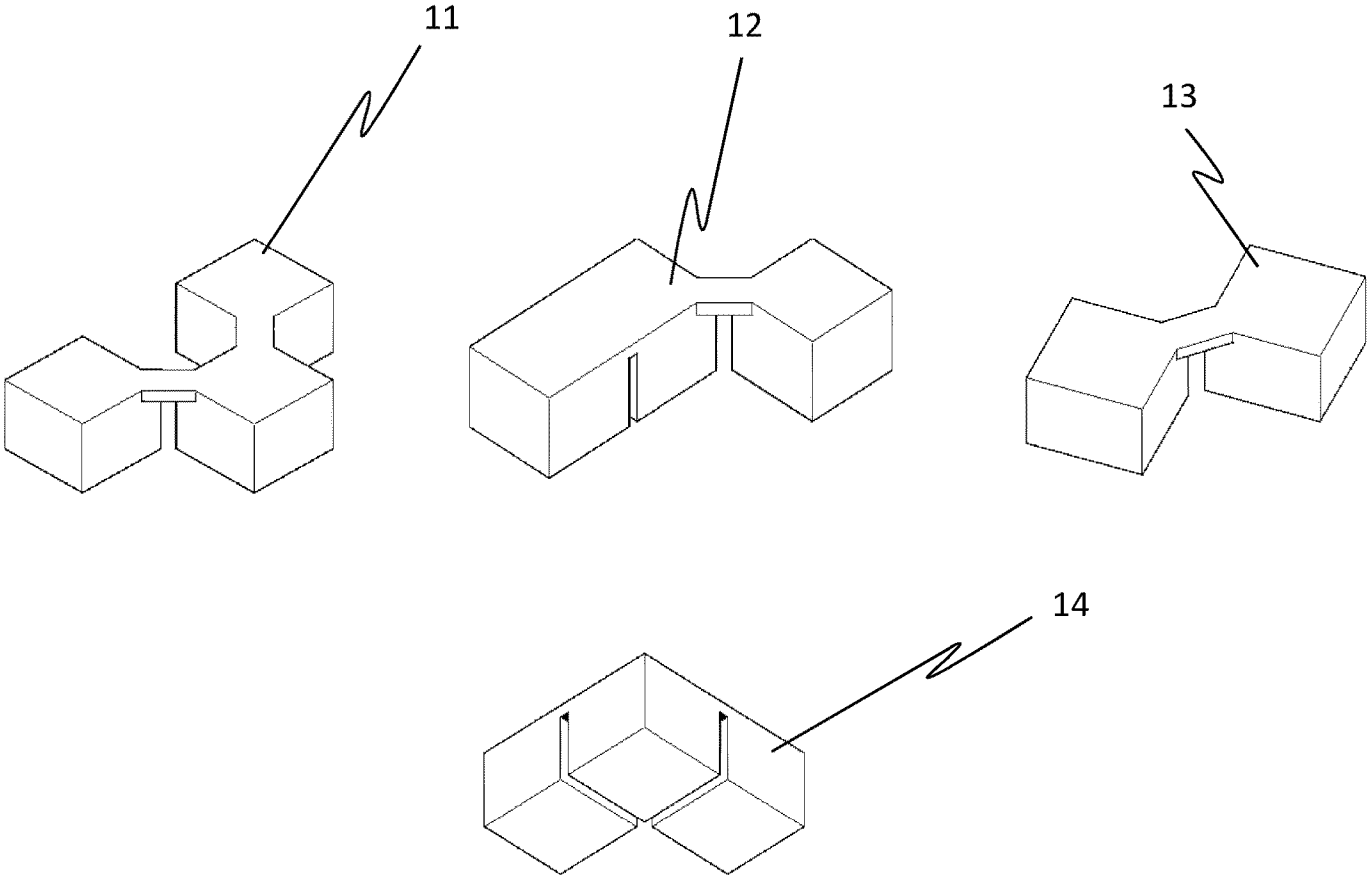
FIG. 2 is a pictorial representation of exemplary, respective pieces of a maze, in accordance with an embodiment of the current invention.
Figure 3:
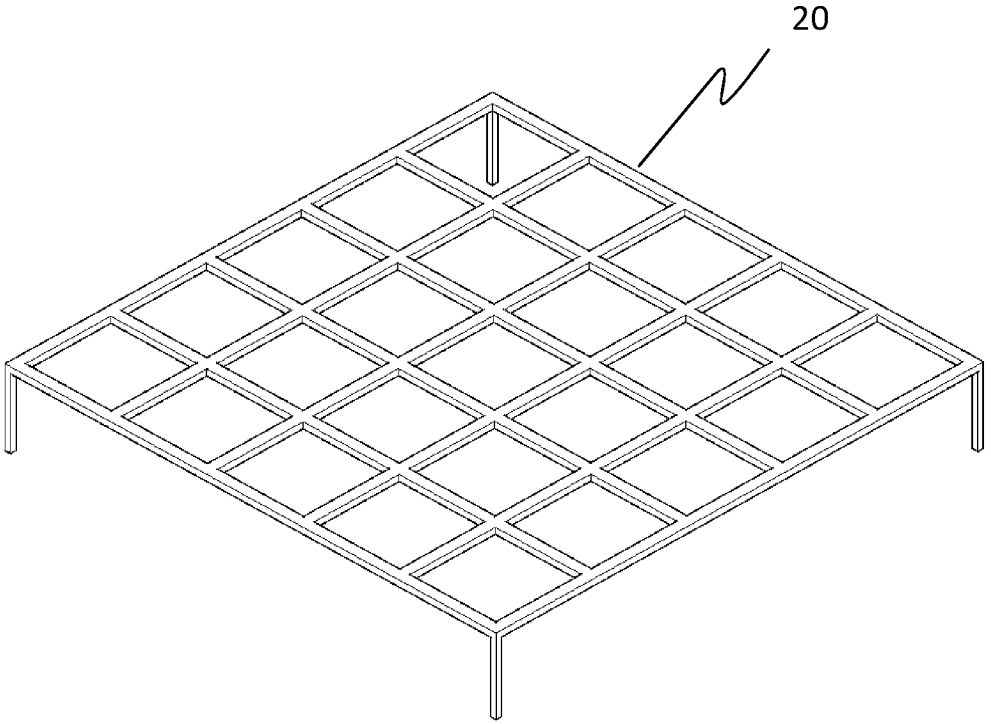
FIG. 3 is a pictorial representation of maze template base, in accordance with an embodiment of the current invention.

Reference is currently made to FIGS. 2 and 3, which are pictorial representations of exemplary respective maze pieces 11, 12, 13, and 14 of the maze (not shown in the current figure) and of a maze template base 20, in accordance with an embodiment of the current invention. All or some of exemplary maze pieces 11, 12, 13, 14 are placed within base 20 to form a required maze structure—as further described hereinbelow.

Every challenge/game has its respective maze structure and instructions, as described further hereinbelow. The player initially assembles the maze before proceeding to solve a specific challenge (i.e. "play a specific game"). Assembling the maze is, in itself, an enjoyable activity and it allows inclusion of young children to participate in the game. As noted hereinabove regarding variability of the board size and the number of squares; maze pieces 11, 12, 13, 14 and maze template base 20 may be correspondingly varied/scaled, mutatis mutandis.

Figure 4A:
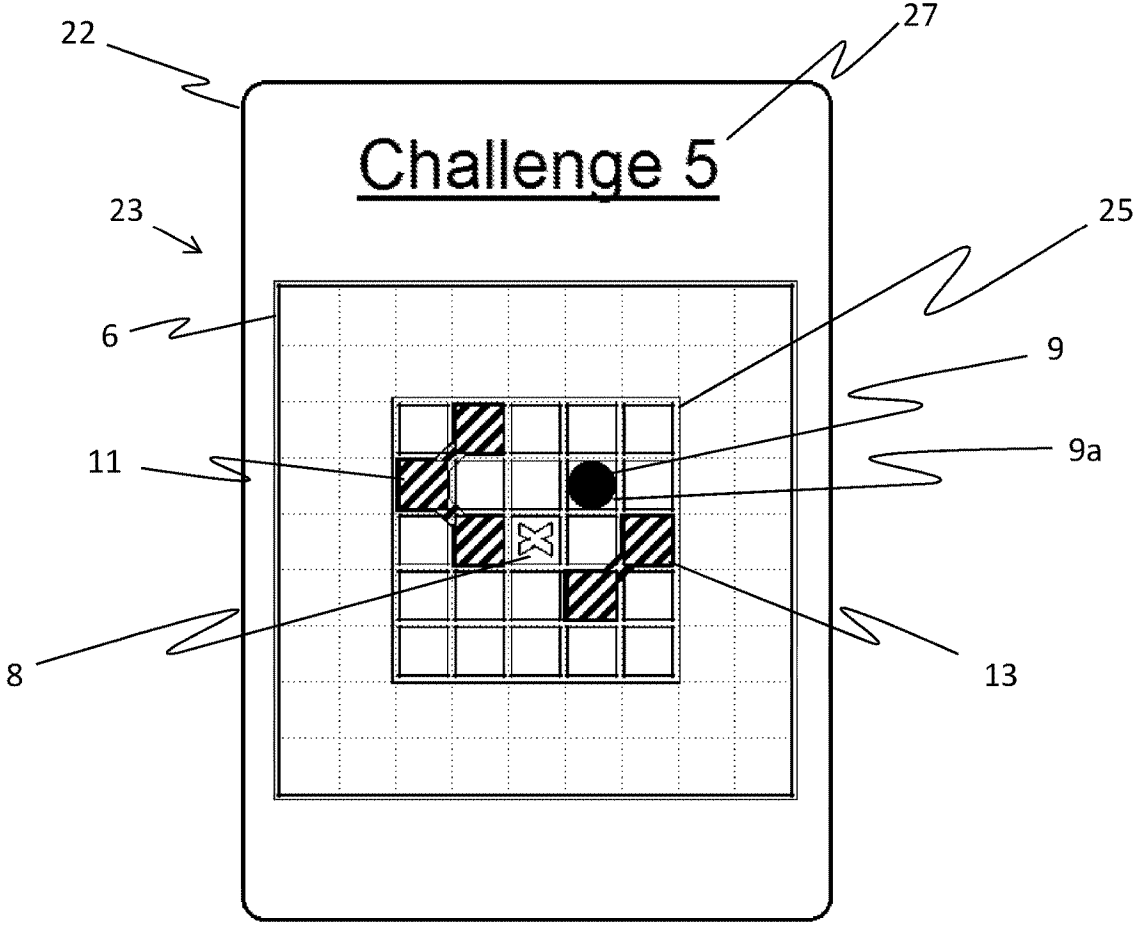
FIG. 4A is a representation of an exemplary challenge card, in accordance with an embodiment of the current invention.
Figure 4B:
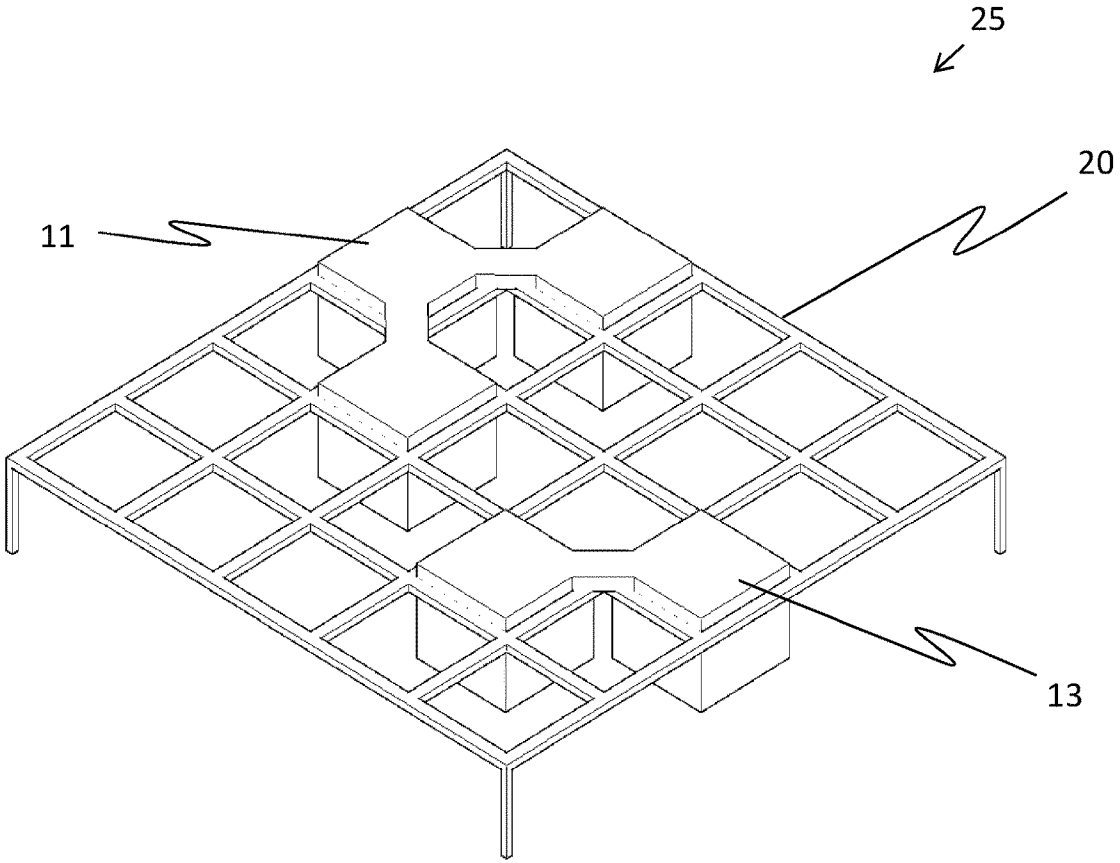
FIG. 4B is an isometric representation of a maze structure, in accordance with an embodiment of the current invention.

Reference is currently made to FIG. 4A, which is a presentation of an exemplary challenge card 22, and to FIG. 4B, which is an isometric representation of a maze structure 25, in accordance with an embodiment of the current invention. Apart from differences described below, board 6, object square 8, and game piece 9 of FIG. 1; maze pieces 11, 12, 13, and 14 of FIG. 2; and maze template base 20 of FIG. 3 are identical in notation, configuration, and functionality to that shown in the respective figures, and elements indicated by the same reference numerals and/or letters are generally identical in configuration, operation, and functionality as described hereinabove.

Maze structure 25 includes maze template base 20 and maze pieces 11 and 13, which have been positioned within the maze template base, as shown in the current figure.

Exemplary challenge card 22 includes game instructions 23 and an exemplary challenge title 27. Game instruction 23 include instructions how to prepare and place elements of the game before play commences, as described hereinbelow. Game instructions 23 include three elements:

A representation of board 6 having a maze structure 25 on the board; and The maze structure is composed of maze pieces 11 and 13, which have been placed in the maze template base, which has been placed upon board 6; and An initial square 9*a* upon which game piece 9 is placed on the board, to start the challenge.

Challenge card 22 additionally shows object square 8 (FIG. 1). As noted hereinabove, other embodiments of logic board game 5 include alternate positions of the object square.

The challenge is played, as noted hereinabove, by initially assembling the maze structure. The player then proceeds to place the game piece on initial square 9*a* and the assembled maze structure on the board—all as specified on the challenge card.

The game then proceeds by translating the maze structure on the game board, one game square at a time in one of 4 orthogonal directions, as described further hereinbelow. The maze structure may be moved along the entire game board. By moving the maze structure as noted hereinabove, the game piece may be moved by being displaced by part of the maze structure (for example, maze pieces 11 and 13). In this way, the game piece can be moved along the game board—and eventually to the object square, which solves the challenge. The maze structure may not be moved less than or more than one square in any direction at a time.

In an embodiment of the current invention one or more mechanical and/or magnetic mechanisms are employed (not shown in the current figure), as known in the art, to constrain maze structure movement in one complete game square in each of the 4 directions. Similarly, one or more mechanisms can be employed to prevent the maze structure from being moved off of the game board, such as an elevated margin at the edge of the board, for example (not shown in the figure).

Continuing with the exemplary challenge card shown in 4A, reference is currently made to FIGS. 5A through 5H, which are representations of an exemplary initial position of the maze structure and the game piece (FIG. 5A) and subsequent maze structure and game piece exemplary positions (FIGS. 5B through 5H), as maze structure 25 and game piece 9 are moved along game board 6, in accordance with an embodiment of the current invention. Apart from differences described below, board 6, object square 8, and game piece 9 of FIG. 1; maze structure 25 of FIGS. 4A and B are identical in notation, configuration, and functionality to that shown in the respective figures, and elements indicated by the same reference numerals and/or letters are generally identical in configuration, operation, and functionality as described hereinabove.

Figure 5C:
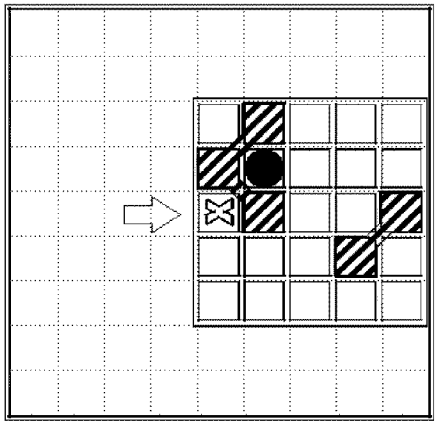
FIGS. 5A through 5H are representations of an exemplary initial position of the maze structure and the game piece (FIG. 5A) and subsequent maze structure and game piece exemplary positions (FIGS. 5B through 5H), as the maze structure and the game piece are moved along the game board, in accordance with an embodiment of the current invention.
Figure 5B:
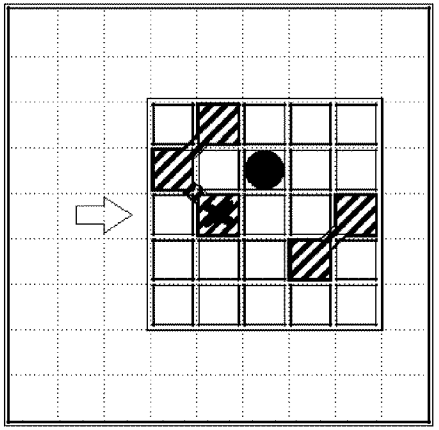
Figure 5A:
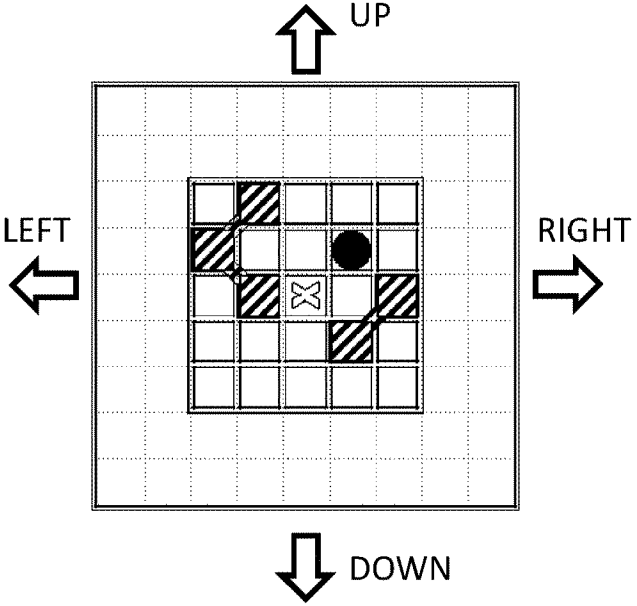
Figure 5F:
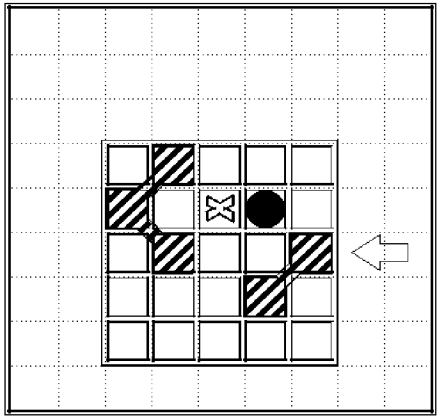

The four orthogonal directions, in which the maze structure may be translated, are indicated by arrows in FIG. 5A, and are called: UP; DOWN; LEFT; and RIGHT, respectively.

Respective notations of board 6, object square 8, game piece 9, initial square 9*a*, and maze pieces 11 and 13, and maze structure 25—all as shown in FIGS. 4A and B—are not repeated in FIGS. 5A through 5H for purposes of clarity, but are to be understood to be all correspondingly similar to those indicated in FIGS. 4A and B.

Figure 4C:
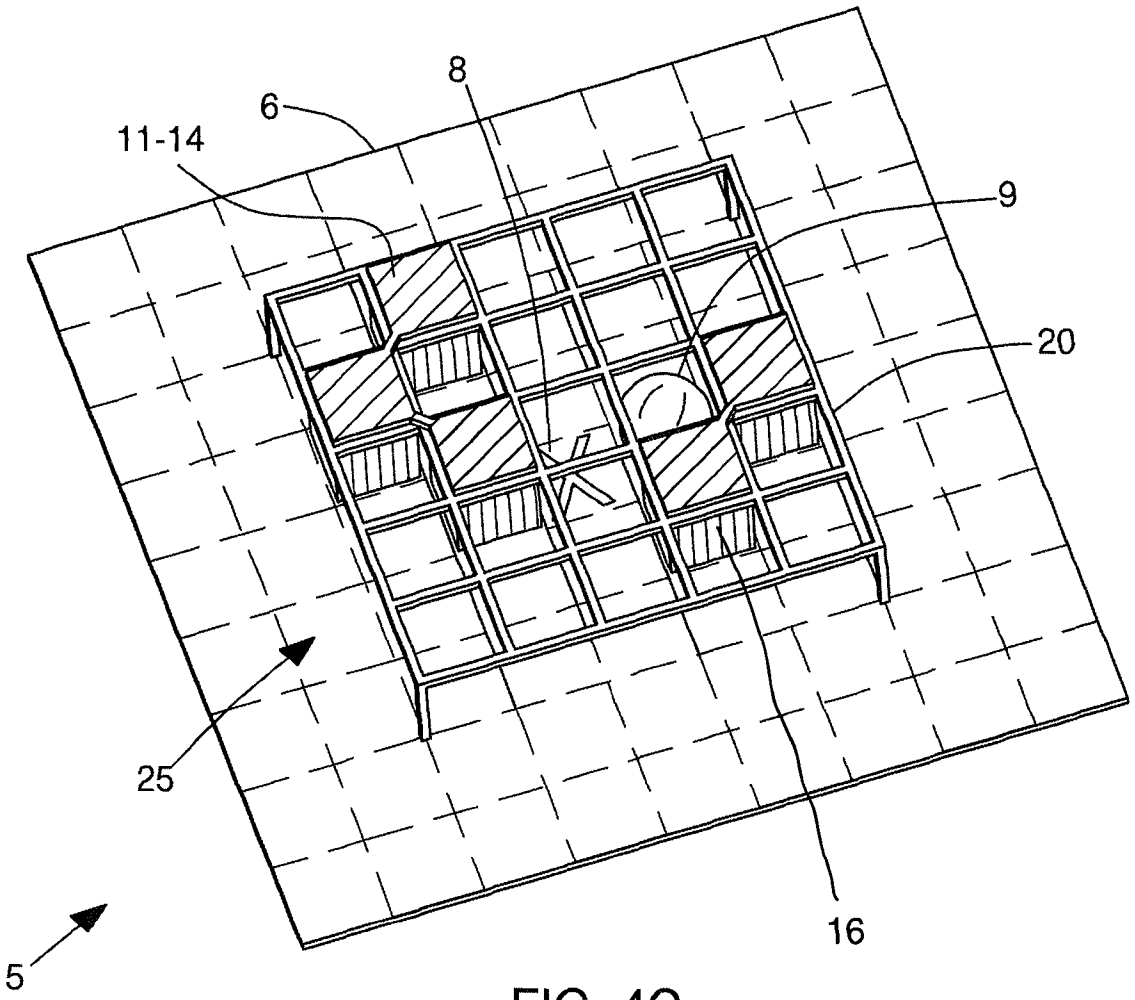
FIG. 4C is a representation of a maze structure placed over the board game of FIG. 1, in accordance with an embodiment of the current invention.

Reference is currently made to FIG. 4C, which is a presentation of maze structure 25 placed over game board 6. Maze structure 25 is constructed of maze template 20 and maze pieces 11-14 placed therein, according to the instructions shown on challenge card 22 (not shown here). Maze piece 11-14 is an interconnected combination of at least two piece-portions, each piece-portion having sides defining walls 16, each being suspended and extending vertically downward from support position openings. Game piece 9 is placed on game board 6, and maze 25 is moved one square at a time in any direction. Only when wall 16 of maze piece 11-14 engages game piece 9 and moves in its direction, game piece 9 is then moved to the adjacent square on game board 6. Game piece 9 will remain on the same square if maze piece 11-14 will not engage game piece 9 when moving maze 25. Multiple moves are done by maze structure 25 until game piece 9 reaches object square 8 marked on game board 6.

Figure 5E:
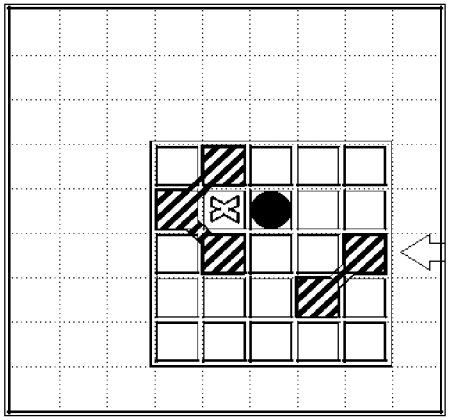
Figure 5D:
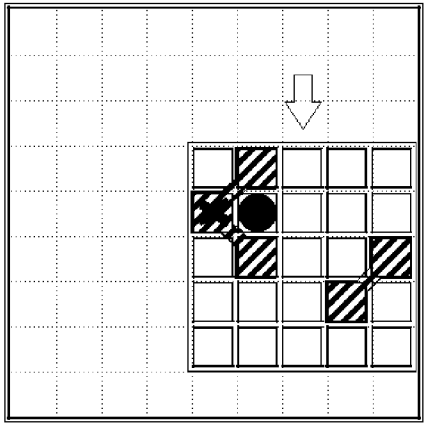
Figure 5H:
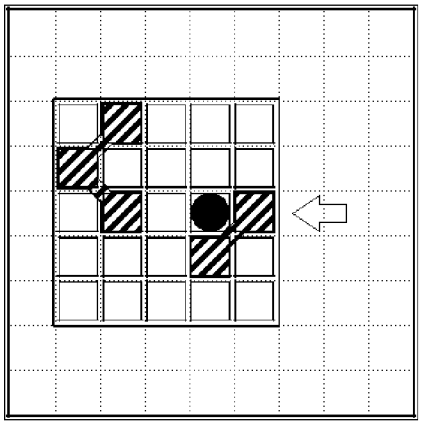
Figure 5G:
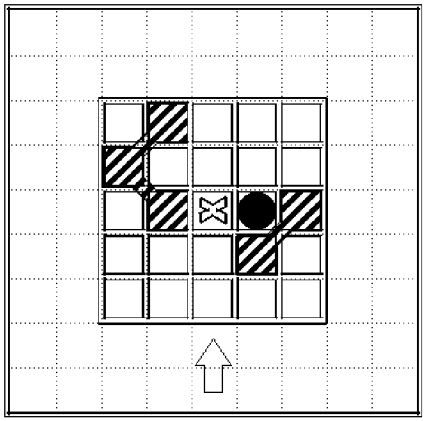

In FIGS. 5B and C, the maze structure is moved to the right, each time by one game square. The game piece stays in place in the initial square in both figures because no part of the maze structure pushes the game piece. In FIG. 5D, with the maze structure having been moved one square down, the game piece is engaged by the maze structure and the game piece is translated one square down. In FIGS. 5E and F, the maze structure is moved to the left, each time by one game square. There is no movement of the game piece in both figures because no part of the maze structure pushes the game piece. In FIG. 5G, the maze structure is moved one square up (no game piece movement) and in FIG. 5H, the maze structure is moved one square to the left—this time pushing the game piece to the left and onto the object square—thereby solving the challenge.

The exemplary challenge described above in FIGS. 5A through 5H (according to exemplary challenge card 22) is a relatively simple challenge, involving a small number of moves of the maze structure. It is to be understood that embodiments of the current invention include a plurality of challenges, each challenge having its challenge card and associated instructions. Other challenges may involve other initial square definition and other maze configurations/structures; and solving the other challenges may involve over 100 moves—representing a much more complicated challenge. In this way the logic board game includes a plurality of challenges, addressing skill levels of young people as well as adults.

Figure 6:
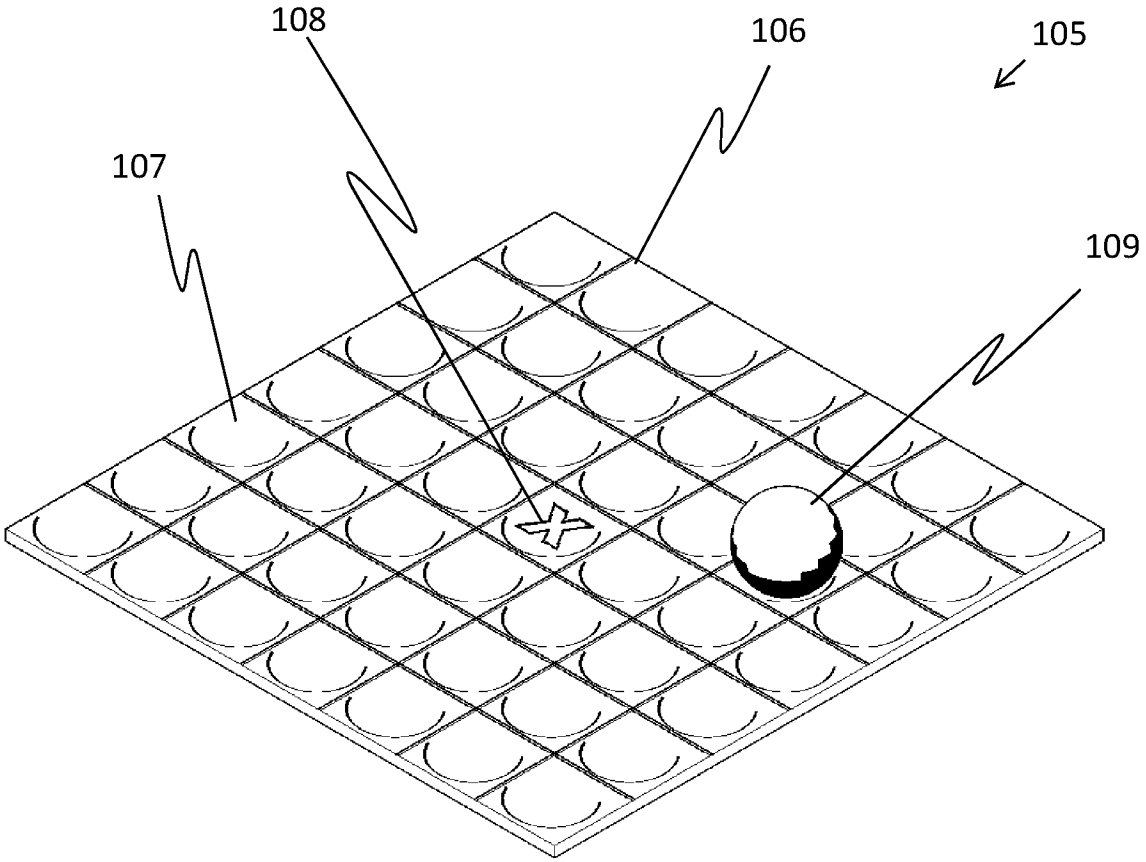
FIG. 6 is a representation of a logic board game (similar to the logic board game of FIG. 1) including a game board and a game piece, in accordance with an embodiment of the current invention.

Reference is currently made to FIG. 6, which is a representation of a logic board game 105 (similar to logic board game 5 of FIG. 1) including a game board 106 and a game piece 109, in accordance with an embodiment of the current invention. In game 105, the game piece is essentially a marble or having a similar, substantially spherical shape and the game board 106 has a series of rounded depressions 107, as shown in the figure, disposed in an orthogonal arrangement, similar to that of the game squares of game 5 of FIG. 1. In game board 106 the game piece remains within a respective rounded depression until the piece is moved to another rounded depression by a maze structure—not shown in the current figure—the maze structure being similar to that described hereinabove with regard to logic board game 5.

In yet another embodiment of the current invention, game piece 109 may be formed of an iron-based metal (for example, but not limited to, stainless steel) and game board 106 may be magnetized, or vice-versa, so that game piece 109 will not roll/move unless it is positively biased, for example, by a maze structure, along board 106.

Figure 7:
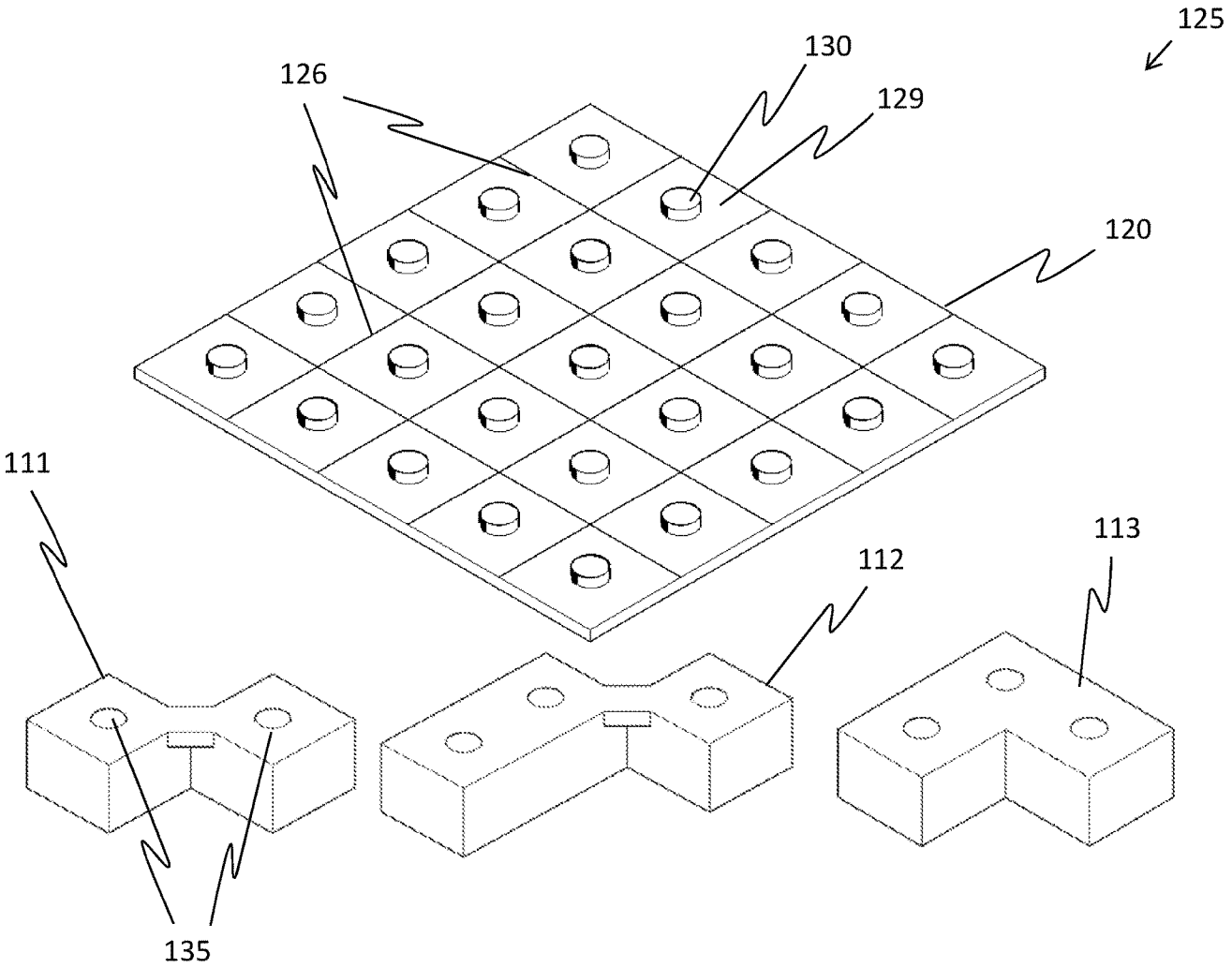
FIG. 7 is an isometric representation of maze pieces and a maze structure, in accordance with an embodiment of the current invention.

Reference is currently made to FIG. 7, which is an isometric representation of maze pieces 111, 112, and 113 and a maze structure 125, in accordance with an embodiment of the current invention. Maze structure 125 includes maze template base 120, upon which maze pieces 111, 112, and 113 may be positioned. Maze template base 120 is made of a transparent and rigid material, such as but not limited to plastic and glass. Lines 126 are drawn on the maze template base, the lines defining game squares 129, in the center of each is a magnet 130. Maze pieces 111-113 have magnetically-attracted metallic circular pieces 135 attached thereupon—and the maze pieces are thereby magnetically positioned upon the maze template base. Maze structure 125 may be used in logic board game 105 (FIG. 6) or in logic board game 5 (FIG. 1).

Figure 8:
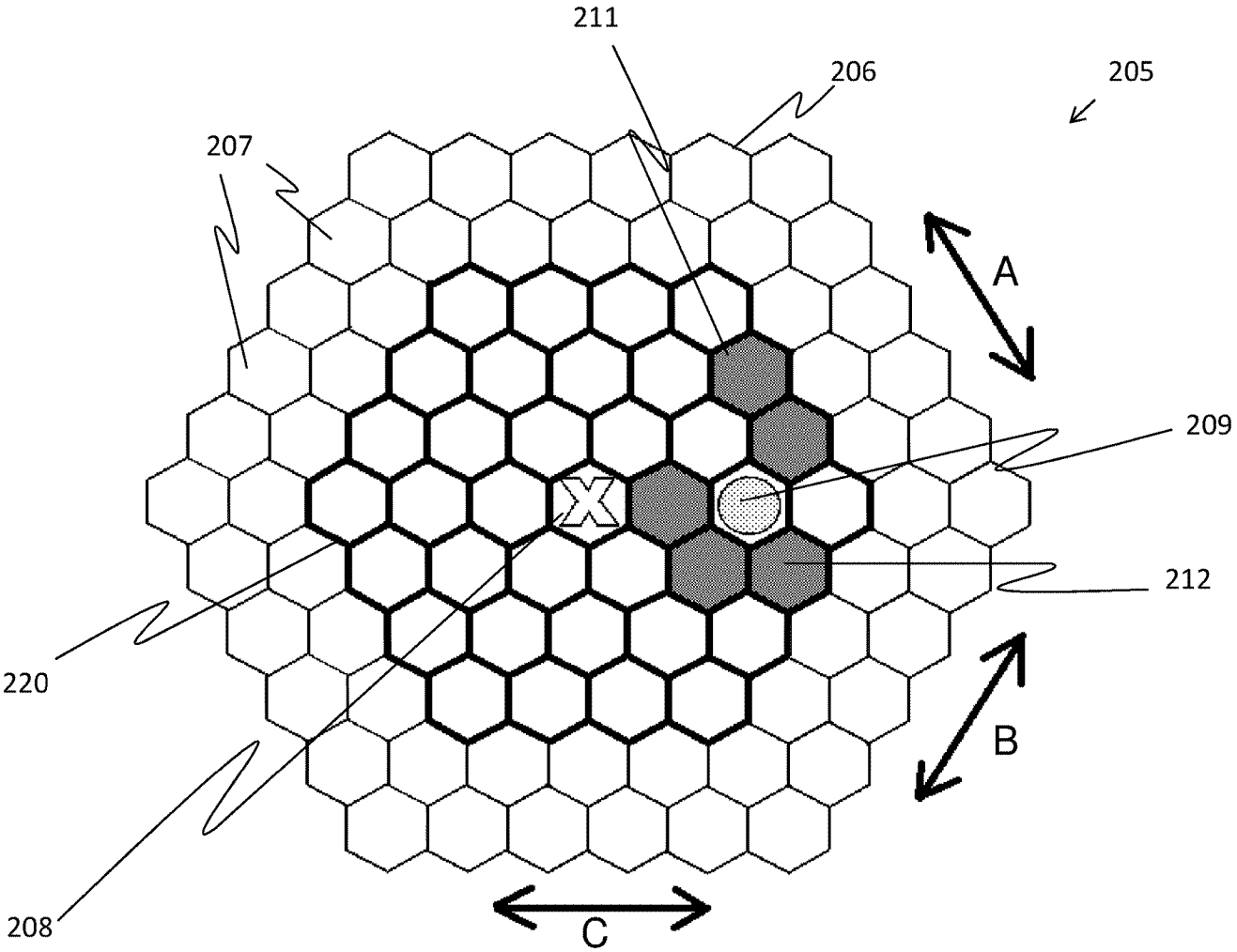
FIG. 8 is a plan view of a logic board game, in accordance with an embodiment of the current invention.

Reference is currently made to FIG. 8, which is a plan view of a logic board game 205, in accordance with an embodiment of the current invention. Logic board game 205 includes: a game board 206 having hexagonal "game squares" 207; an object square 208; and a game piece 209. A maze structure 220 has two exemplary maze pieces 211 and 212 in position. Maze structure 220 of logic board game 205 is moved upon game board 206 to move game piece 209 to object square 208 in similar fashion as in logic board game 105 (FIG. 6) and logic board game 5 (FIG. 1). The maze structure of logic board game 205 is translated in 6 possible directions on the game board, which has a hexagonal configuration, as indicated by the arrows A, B, and C in the figure.

Figure 9:
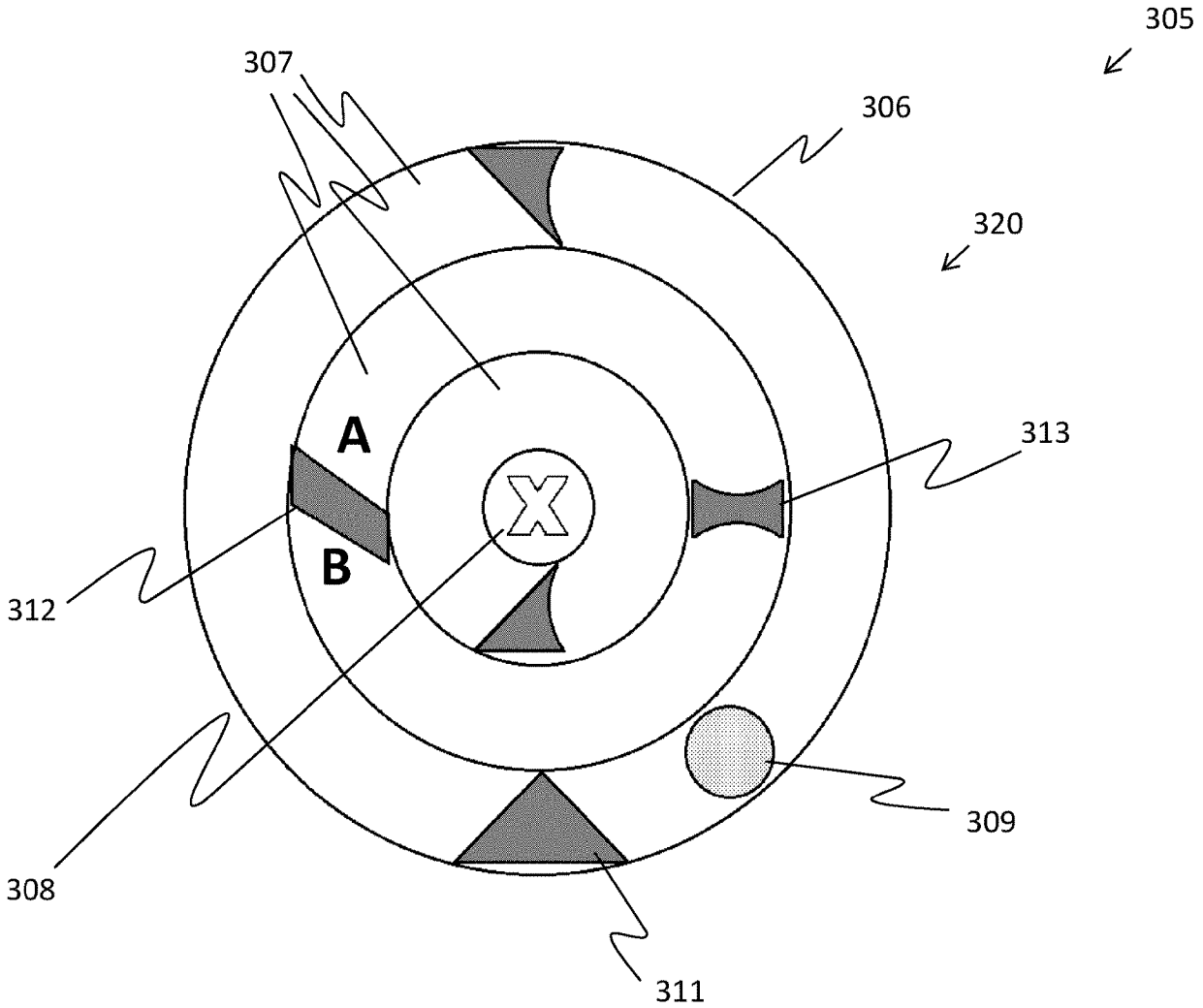
FIG. 9 is a plan view of logic board game, in accordance with an embodiment of the current invention.

Reference is currently made to FIG. 9, which is a plan view of logic board game 305, in accordance with an embodiment of the current invention. Logic board game 305 has a circular game board 306 and logic board game 305 is a variant of logic board game 105 (FIG. 6) and logic board game 5 (FIG. 1).

Logic board game 305 has "game squares" identified by concentric paths 307 as shown in the figure, an "object square" 308, and a game piece 309. A maze structure 320 includes exemplary maze pieces 311, 312, and 313, which are positioned to correspond to respective concentric paths 307. Game piece 309 is advanced in similar fashion to that in logic board game 105 (FIG. 6) and in logic board game 5 (FIG. 1); however in logic board game 305, maze structure 320 is rotated (clockwise or counterclockwise).

When game piece 309 is contacted by one of the maze pieces, there are three possible outcomes as to how the game piece will move/not move according to respective maze piece positions and according to how respective concentric paths 307 of the maze structure are rotated:

1. The game piece is translated to an inner concentric path, for example: when maze piece 312 biases the game piece from the side indicated "A" in the figure (resulting from a clockwise rotation of the maze structure); or
2. The game piece is translated to an outer concentric path, for example: when maze piece 312 biases the game piece from the side indicated "B" in the figure (resulting from a counter-clockwise rotation of the maze structure); or
3. The game piece is translated but remains in the current concentric path (for example according to maze piece 313).

In all of the embodiments described hereinabove, and as previously noted, the game board may be divided into a larger number of game squares. Optionally or alternatively, more than one object square may be specified for a specific challenge. Optionally or alternatively, more than one game piece may be used in a challenge. It is readily understood that any one of the above-mentioned options/alternatives, taken by itself or in combination with other options/alternatives, serve/s to provide a more complicated and challenging game.

Among the advantages of embodiments of the current invention are, inter alia:

- The game rules are straightforward and simple, allowing adults and children alike to understand them, thereby allowing the child to connect to the game;
- The game, in its variations, is fun to play—as follows:
  - Children love maze games, as can be seen by the plethora of maze games available in the market;
  - Solving a maze give a strong sense of satisfaction;
  - A feeling of progression. (In some logic games, the child may be left with no encouragement along the way until he suddenly solves the game. This of course can lead a child to be frustrated when not being able to solve the game in an allotted time.) Embodiments of the current invention, while playing the game, the child progressively learns the specific maze structure and how to solve the game—imparting upon him a feeling of progression, up to the point of solving the challenge; and
- Maintain interest over time. Embodiments of the current invention include:
  - Continued physical movement—allowing involvement, immersion, and interest;
  - A large number of increasingly difficult challenges—enabling the child to start "new territory" with each new challenge;

It will be appreciated that the above descriptions are intended only to serve as examples, and that many other embodiments are possible within the scope of the present invention as defined in the appended claims.

The invention claimed is:

1. A board logic game having a plurality of challenges for at least one player, said game comprising:

a game board comprising game squares wherein said game squares comprise at least one object square marked by a symbol, said at least one marked object square representing the object of the game;

a maze structure comprising a maze template placed over said game board, said maze template having an array of support position openings corresponding to said game squares, said maze structure further comprising at least one maze piece being positioned in any location of said support position openings within said maze template as specified by a challenge card, said at least one maze piece comprising an interconnected combination of at least two piece-portions, each piece-portion having sides defining maze piece walls each being suspended and extending vertically downward from at least two of said support position openings of said maze template towards said game board; and at least one game piece shaped to fit within said game square, and being configured to be displaced between game squares, said maze structure configured to be movable in sliding fashion along the game board, one game square at a time with said maze piece wall serving to advance said game piece from square to square, wherein one of said plurality of challenges is solved by movement of said maze structure along said game board so that said at least one game piece is indirectly advanced by said maze piece wall to said at least one object square.

2. The board logic game of claim 1, wherein said game squares are disposed in an orthogonal configuration and the at least one game piece has a substantially truncated cylindrical configuration.

3. The board logic game of claim 2, wherein said maze structure is configured to be moved in one of four possible directions along said game board.

4. The board logic game of claim 1, wherein said game board has a plurality of rounded depressions disposed in an orthogonal arrangement corresponding to said game squares and said at least one game piece has a substantially spherical configuration, and said at least one game piece configured to rest in one of said plurality of rounded depressions.

5. The board logic game of claim 1, wherein said game squares are disposed in a hexagonal configuration and said at least one game piece has a substantially truncated cylindrical configuration.

6. The board logic game of claim 5, wherein said maze structure is configured to be moved in one of six possible directions on said game board.

7. The board logic game of claim 1, wherein said game squares are identified by concentric paths and said at least one game piece has a substantially truncated cylindrical configuration.

8. The board logic game of claim 7, wherein said maze structure is configured to be rotated in one of two circular directions on said game board.

9. The board logic game of claim 1, wherein said at least one game piece and said at least one maze template piece are retained in position by at least one mechanism chosen from the list including: gravitation, mechanical, and magnetic.

* * * * *